United States Patent [19]

Raich

[11] 4,054,694

[45] Oct. 18, 1977

[54] METHOD FOR APPLYING FATIGUE-RESISTANT SURFACE COATING

[75] Inventor: Henry Raich, Cherry Hill, N.J.

[73] Assignee: Mobil Oil Corporation, New York, N.Y.

[21] Appl. No.: 634,727

[22] Filed: Nov. 24, 1975

[51] Int. Cl.[2] ..... B05D 3/00; B05D 3/02

[52] U.S. Cl. ..... 427/352; 252/49.8; 260/967; 260/976; 427/388 R

[58] Field of Search ..... 252/49.8; 427/352, 388 R; 260/967, 976

[56] References Cited

U.S. PATENT DOCUMENTS 3,329,742 7/1967 Myers ..... 252/49.8 X

*Primary Examiner*—Michael R. Lusignan

*Attorney, Agent, or Firm*—Charles A. Huggett; Raymond W. Barclay; Thomas S. Szatkowski

[57] ABSTRACT

Means are provided for imparting an adherent wear and fatigue-resistant thin surface film on a metal object prior to contact of said object with another surface by the application of dinonylphenyl hydrogen phosphonate to form a surface reaction coating on the metal object.

8 Claims, No Drawings

METHOD FOR APPLYING FATIGUE-RESISTANT SURFACE COATING

BACKGROUND OF THE INVENTION

1. Field of the Invention

This invention relates to a method for imparting a fatigue and wear-resistant protective coating on a metal surface.

2. Description of the Prior Art

Metal objects such as gears, bearing components, splines, cams, cutting tools, knives, razor blades, pumps, compressors and the like, when in use in relative motion with other surfaces, are subject to contact, to wear and to cyclic stressing leading to fatigue, impairing their useful lives. Prior to the present invention, as described in commonly assigned U.S. Pat. 3,329,742, dinonylphenyl hydrogen phosphonate has been added to lubricating oils as an antioxidant and extreme pressure additive. It has been found when lubricating oil compositions containing dinonylphenyl phosphonate are used, wear rate is reduced and fatigue life is increased; these improvements have been attributed to the presence of reaction films formed with the metal surfaces under dynamic conditions of service.

SUMMARY OF THE INVENTION

In accordance with the present invention, it has been found that metal objects, prior to contact with another metal surface can be treated to provide adherent wear-resistant surface films by contact and reaction with dinonylphenyl hydrogen phosphonate, alone, or with solutions of dinonylphenyl hydrogen phosphonate in a suitable solvent. When dinonylphenyl hydrogen phosphonate alone is applied to a metal part, an adherent surface reaction film forms, and the excess dinonylphenyl hydrogen phosphonate can be removed by wiping or other physical removal means. In instances where the dinonylphenyl hydrogen phosphonate is first dissolved in a suitable non-reactive solvent, for example, hydrocarbon solvents, mineral oils, esters and the like, after reaction with the metal surface has taken place, and the excess solution removed, the now coated metal object can be washed with a solvent in which the non-reactive solvent is soluble, and dried. A non-lubricating solvent may be employed as the non-reactive solvent in which the dinonylphenyl hydrogen phosphonate is dissolved. Where the dinonylphenyl hydrogen phosphonate is employed in the form of a solution, the dinonylphenyl hydrogen phosphonate may be employed in any amount effective to yield a coating of desired thickness. For many applications, solutions may be employed in which the dinonylphenyl hydrogen phosphonate is present in an amount from about 0.001 to about 5%, and preferably from about 0.1 to about 3%, by weight.

In other modifications of the invention, the dinonylphenyl hydrogen phosphonate surface reaction coatings can be formed on metal parts after they have been machined to final dimensions and heat-treated, carburized, etc. The surface coating can also be formed by incorporating the dinonylphenyl hydrogen phosphonate in the cutting, grinding, honing or other fluids employed in the final surface finish of the metal part, or in quenching oils employed in final heat treating, thereby reducing processing steps. Dinonylphenyl hydrogen phosphonate can be applied to the metal part by such conventional means as painting, spraying or dipping.

DESCRIPTION OF SPECIFIC EMBODIMENTS

The following example will serve to illustrate the novel method of the present invention in which films of dinonylphenyl hydrogen phosphonate are effectively applied to metal objects as wear-resistant and fatigue-resistant coatings.

EXAMPLE

A series of ball-bearings were immersed in a lubricant comprising hydrogenated polydecene containing 0.1%, by weight, dinonylphenyl hydrogen phosphonate. Some of these bearings were machined from SAE-52100 steel and others were machined from M-50 tool steel. The immersed bearings, under static conditions, were heated for periods of about 16 hours at temperatures within the range of 150° F to 250° F. After cooling and cleaning, the dried bearings were found to have thin surface films on the balls, races and retainers indicated by the appearance of blueish colors and/or dull surface films. These adherent films could not be removed by scratching.

I claim:

1. A method for forming an adherent, wear and fatigue resistant, protective film on a surface of a metal object, prior to contact of the object with another metal surface, which comprises:

a. coating and reacting the surface of the object with a solution of dinonylphenyl hydrogen phosphonate in a non-reactive solvent;

b. thereafter removing the non-reactive solvent with a solvent in which the non-reactive solvent is soluble; and, c. drying the metal object after removal of the non-reactive solvent from the surface thereof.

2. The method of claim 1 in which the non-reactive solvent is selected from the group consisting of hydrocarbon solvents, mineral oils and esters.

3. The method of claim 1 wherein the non-reactive solvent is a non-lubricating solvent.

4. The method of claim 1 in which the dinonylphenyl hydrogen phosphonate is incorporated into the non-reactive solvent in an amount from about 0.001 to about 5%, by weight.

5. The method of claim 1 in which the dinonylphenyl hydrogen phosphonate is incorporated into the non-reactive solvent in an amount from about 0.1 to about 3%, by weight.

6. The method of claim 1 wherein the reaction takes place at a temperature within the range of 150° F to 250° F.

7. A method for forming an adherent, wear and fatigue resistant, protective film on a surface of a metal object, prior to contact of the object with another metal surface, which comprises:

a. coating and reacting the surface of the object with dinonylphenyl hydrogen phosphonate alone, and b. removing excess dinonylphenyl hydrogen phosphonate from the surface of the object.

8. The method of claim 7 wherein the reaction takes place at a temperature within the range of 150° F to 250° F.

* * * * *